US006848813B2

(12) United States Patent
Patz et al.

(10) Patent No.: US 6,848,813 B2
(45) Date of Patent: Feb. 1, 2005

(54) LIGHTING FIXTURE MOUNTING SYSTEM

(75) Inventors: Jason D. Patz, Jacksonville, FL (US); Robert J. Pape, Ponte Vedra Beach, FL (US); Brian S. Sibson, Jacksonville, FL (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 10/461,408

(22) Filed: Jun. 16, 2003

(65) Prior Publication Data

US 2004/0252506 A1 Dec. 16, 2004

(51) Int. Cl.[7] ..... F21V 21/00
(52) U.S. Cl. ..... 362/432; 362/147; 362/370
(58) Field of Search ..... 362/147, 370, 362/432, 430

(56) References Cited

U.S. PATENT DOCUMENTS 4,104,713 A * 8/1978 Chan et al. ..... 362/294
4,245,284 A * 1/1981 Moore et al. ..... 362/311
6,257,743 B1 * 7/2001 Ursch ..... 362/418
6,595,664 B2 * 7/2003 Bucher et al. ..... 362/404
6,623,138 B1 * 9/2003 Hsu ..... 362/147

* cited by examiner

*Primary Examiner*—Laura K. Tso
(74) *Attorney, Agent, or Firm*—Baker Donelson

(57) ABSTRACT

A light fixture mounting system (11) is disclosed having a cover plate (14) having a pair of post holes (17) therethrough, a mounting plate (21) has two, oppositely disposed peripheral hooks or catches (25), a latch bar (31), and two threaded posts (35). Each catch (25) has a horizontal portion (27) and a vertical portion (28) extending upwardly and terminating with a tang (29). The latch bar is coupled to the cover plate (14) for reciprocal movement between an engaged position distal the cover plate and a locked position proximal the cover plate. The latch bar (31) has two internally threaded adjustment holes (32) which are configured and threaded to receive two threaded posts (35) which extend through the cover plate post holes (17). Each post has a head portion (36) which may be configured to receive the drive end of a screwdriver or may be externally configured to enable one to grasp and rotate it with ease.

10 Claims, 2 Drawing Sheets

LIGHTING FIXTURE MOUNTING SYSTEM

TECHNICAL FIELD

This invention relates generally to lighting fixtures, and more particularly to the mounting systems for light fixtures.

BACKGROUND OF THE INVENTION

Lighting fixtures have existed for many years. These lighting fixtures may include chandeliers, ceiling lights, wall lights or sconces, and may include other systems such as ceiling fans which may include lights.

Light fixtures are typically mounted to junction boxes that are recessed within a ceiling or wall and mounted to a joist or wall stud. During a conventional installation of a light fixture a mounting bar is coupled to the junction box through a pair of screws. The mounting bar has a centrally located internally threaded mounting hole in which is threadably mounted an externally threaded nipple. The nipple is passed through a control hole in the light fixture mounting plate and a threaded nut is threaded onto the nipple to secure the cover plate to the mounting bar. In mounting fixtures to the ceiling or heavy wall mounted fixtures it is awkward for an installer to lift the light fixture while simultaneously performing the just described mounting task.

Accordingly, it is seen that a need remains for a light fixture mounting system which is easy for an installer to mount. It is to the provision of such therefore that the present invention is primarily directed.

SUMMARY OF THE INVENTION

In a preferred form of the invention a lighting fixture mounting system comprises a mounting plate having at least one catch, a cover plate, lighting means mounted to the cover plate, a latch movably mounted to the cover plate, and drawing means for drawing the latch towards and away from the cover plate. With this construction, the latch is grasped by the catch to coupled the cover plate to the mounting plate, then the drawing means are engaged to draw the latch towards the cover plate to fix the cover plate to the mounting plate.

DETAILED DESCRIPTION

Figure 1:
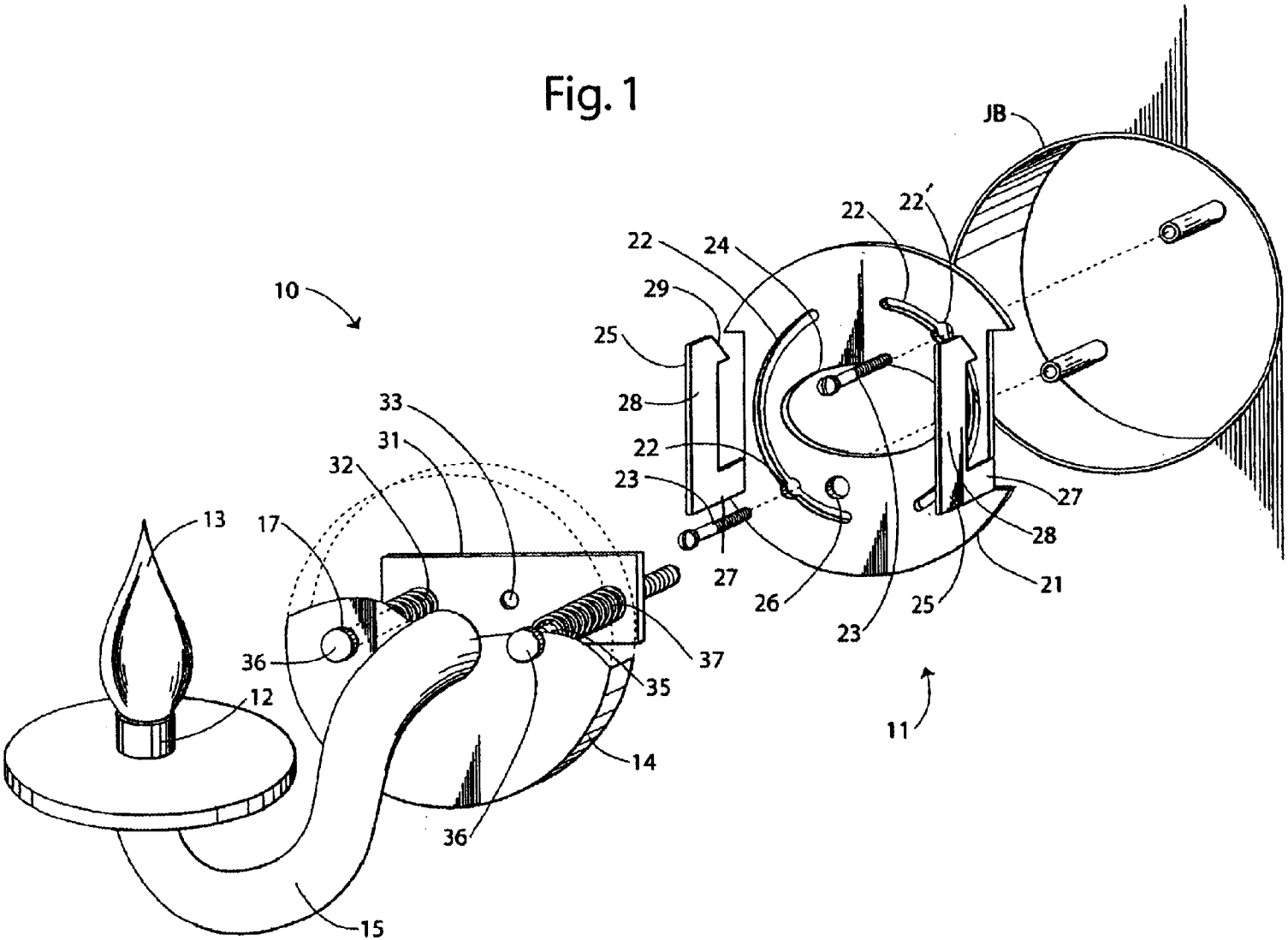
FIG. 1 is a perspective view of a lighting fixture mounting system embodying principles of the invention in a preferred form.

With reference next to the drawings, there is shown a light fixture 10 including a mounting system 11 embodying principles of the invention in a preferred form. The light fixture 10 is shown in the form of a wall mounted sconce, however, it should be understood that the present invention may be utilized with any type of light fixture, including but not limited to, ceiling fixtures, chandeliers, wall lights, and other devices such as ceiling fans.

The light fixture 10 includes a light socket 12, a light bulb 13 mounted within the light socket 12, a cover plate 14 and an arm 15 extending between the cover plate 14 and the light socket 12. The cover plate 14 has a pair of post holes 17 therethrough.

The mounting system 11 also includes a mounting plate 21 having two arcuate mounting hole slots 22 having an enlarged portion 22' therethrough through which mounting screws 23 extend and are threaded into the threaded receiving holes of a conventional junction box JB. The mounting plate 21 also has an enlarged central opening 24, an electrical wiring hole 26, and two, oppositely disposed peripheral hooks or catches 25. Each catch 25 has a horizontal portion 27 and a vertical portion 28 extending upwardly and terminating with a tang 29.

Figure 2:
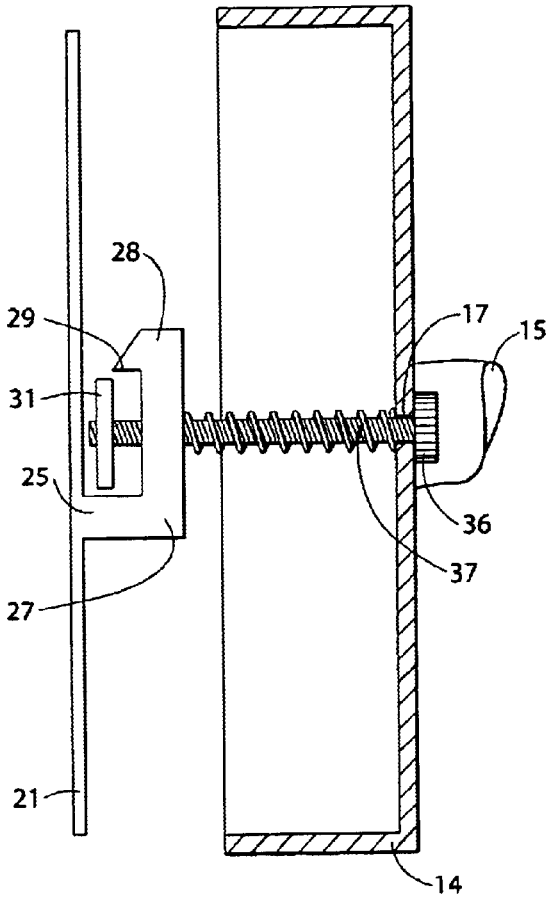
FIG. 2 is a side view, in partial cross-section, of the mounting system of FIG. 1, shown in an engaged position.
Figure 3:
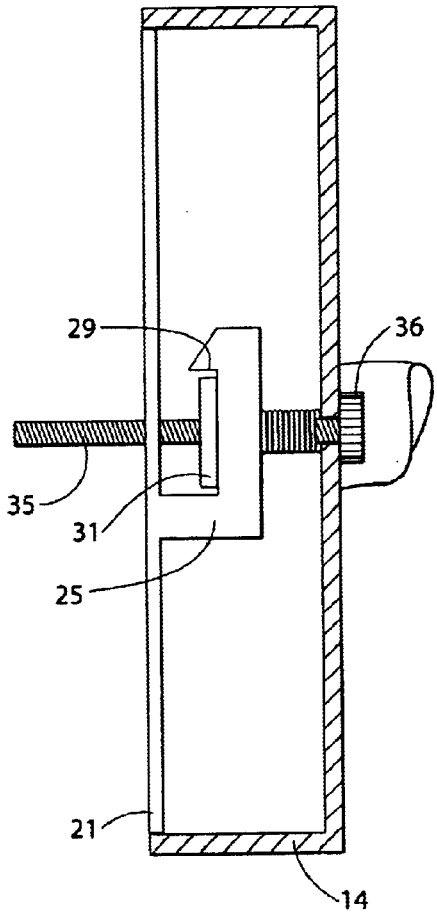
FIG. 3 is a side view, in partial cross-section, of the mounting system of FIG. 1, shown in a locked position.

Lastly, the mounting system 11 includes a latch or latch bar 31 which is coupled to the cover plate 14 for reciprocal movement between an engaged position distal the cover plate 14, as shown in FIG. 2, and a locked position proximal the cover plate 14, as shown in FIG. 3. The latch bar 31 has two internally threaded adjustment holes 32 and a central electrical wiring hole 33 therethrough. The two adjustment holes 32 are configured and threaded to receive two threaded posts 35 which extend through the cover plate post holes 17. Each post 35 has a head portion 36 which may be configured to receive the drive end of a screwdriver or may be externally configured to enable one to grasp and rotate it with ease. A spring 37 is mounted upon each post 35 between the latch bar 31 and the cover plate 14 so as to bias the latch bar 31 away from the cover plate 14.

In use, the mounting plate 21 is secured to the junction box JB by passing the head portion of the mounting screws 23 through the enlarged portion 22' of the mounting hole slots 22. The mounting plate 21 is then rotated so that the head portion of the screws 23 abuts the mounting plate adjacent the narrower portion of the mounting hole slots, the mounting screws 23 are then tightened to secure the position of the mounting plate 21. Conventional electrical wires are pulled through the electrical wiring hole 26 in the mounting plate 21, through the wiring hole 33 in the latch bar 31, and connected to the electrical wires extending from the light socket 12. The coupling of the electrical wiring may be accomplished through splicing or through conventional connectors.

Once the mounting plate 21 is secured to the junction box with the vertical portions 28 of the catches 25 preferably extending upwardly, with respect to wall mounted lighting fixtures, the latch bar 31 is hooked onto the catches 25 so that the latch bar 31 comes to rest upon the horizontal portion 27 of the catches 25. With the latch bar 31 secured in the engaged position the weight of the light fixture rests upon the mounting plate 21.

An operator then rotates the posts 35, by grasping or driving and rotating heads 36, so that the posts 35 threadably move or draw the latch bar 31 towards the cover plate 14, i.e., the threaded posts move the latch bar 31 to its locked position. Once the latch bar 31 is moved firmly against the vertical portions 28 of the catches 25 the light fixture is locked in position, as shown in FIG. 3. The tangs 29 prevent the upward movement of the latch bar 31 to avoid accidentally disengaging the light fixture from the wall should the cover plate be moved upwardly.

It should be understood that the springs 37 help to maintain the latch bar 31 away from the cover plate 14 to ease the coupling of the latch bar 31 to the catches 25 and to maintain the latch bar 31 against the vertical portion 28 during the mounting of the cover plate.

It should also be understood that the central opening 24 allows the passage of the posts 35 through the mounting plate in securing the cover plate to the mounting plate.

It thus is seen that a light fixture which may be mounted quickly and easily and thus overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

What is claimed is:

1. A lighting fixture mounting system comprising:

a mounting plate having at least one catch;

a cover plate;

lighting means mounted to said cover plate;

a latch movably mounted to said cover plate; and drawing means for drawing said latch towards and away from said cover plate, whereby the latch is grasped by the catch to coupled the cover plate to the mounting plate, then the drawing means are engaged to draw the latch towards the cover plate to fix the cover plate to the mounting plate.

2. The lighting fixture of claim 1 wherein said drawing means comprises a threaded post threadably mounted to said latch.

3. The lighting fixture of claim 2 wherein said threaded post extends through said cover plate and includes a head opposite said latch.

4. The lighting fixture of claim 2 wherein said drawing means further includes a spring biasing said latch away from said cover plate.

5. The lighting fixture of claim 4 wherein said spring is mounted about said post.

6. A lighting fixture mounting system comprising:

a mounting plate having a pair of catches;

a cover plate coupled to lighting means, and a latch bar, said latch bar being movable between a engaged position distal said cover plate and a locked position proximal said cover plate, whereby the latch bar may be coupled to said catches then moved from its engaged position to its locked position to lock the cover plate to the mounting plate.

7. The lighting fixture mounting system of claim 6 wherein said latch bar includes drawing means for reciprocally moving said latch bar between the engaged position and the locked position.

8. The lighting fixture mounting system of claim 7 wherein said drawing means comprises a threaded post threadably mounted to said latch.

9. The lighting fixture mounting system of claim 8 wherein said threaded post extends through said cover plate and a head opposite said latch.

10. The lighting fixture of claim 6 wherein said drawing means further includes a spring biasing said latch away from said cover plate.

* * * * *